United States Patent [19]

Morita

[11] Patent Number: 4,480,361

[45] Date of Patent: Nov. 6, 1984

[54] CLASP UTILIZING ATTRACTIVE FORCE OF PERMANENT MAGNET

[76] Inventor: Tamao Morita, 47-1, 6-chome, Arakawa, Arakawa-ku, Tokyo, Japan, 116

[21] Appl. No.: 446,211

[22] Filed: Dec. 2, 1982

[30] Foreign Application Priority Data

Dec. 16, 1981 [JP] Japan ..... 56-204443

[51] Int. Cl.[3] ..... H01F 3/12

[52] U.S. Cl. ..... 24/303; 24/49 M; 248/206.5; 292/251.5; 335/236

[58] Field of Search ..... 24/303, 399, 400, 576, 24/49 M; 248/206.5; 292/251.5; 335/236

[56] References Cited

U.S. PATENT DOCUMENTS

| | | | |
|---|---|---|---|
| 496,408 | 5/1893 | Hall | 24/94 |
| 1,829,361 | 10/1931 | Lane | 24/94 |
| 2,733,092 | 1/1956 | Teetor | 292/251.5 |
| 2,970,857 | 2/1961 | Squire | 24/303 |
| 2,975,497 | 3/1961 | Budreck | 24/303 |
| 3,009,225 | 11/1961 | Budreck | 24/303 |
| 3,034,025 | 5/1962 | Budreck et al. | 24/303 |
| 3,041,697 | 7/1962 | Budreck | 24/303 |
| 3,086,268 | 4/1963 | Chaffin, Jr. | 24/303 |
| 3,111,737 | 11/1963 | Heil | 24/303 |
| 3,141,216 | 7/1964 | Brett | 24/303 |
| 3,192,747 | 7/1965 | Stupell et al. | 24/303 |
| 3,324,521 | 6/1967 | Humiston | 24/303 |
| 3,372,443 | 3/1968 | Daddona, Jr. | 24/303 |
| 3,448,495 | 6/1969 | Chernack et al. | 24/94 |
| 3,589,341 | 6/1971 | Krebs | 24/303 |
| 4,021,891 | 5/1977 | Morita | 292/251.5 |
| 4,265,002 | 5/1981 | Hosken | 24/303 |
| 4,310,188 | 1/1982 | Aoki | 292/251.5 |

FOREIGN PATENT DOCUMENTS

| | | | |
|---|---|---|---|
| 1180547 | 6/1959 | France | 292/251.5 |
| 1268582 | 6/1961 | France . | |
| 281897 | 1/1931 | Italy . | |
| 2500979 | 7/1948 | Switzerland . | |

*Primary Examiner*—Victor N. Sakran
*Attorney, Agent, or Firm*—Holman & Stern

[57] ABSTRACT

A magnetic clasp which protects magnetic records from being adversely affected by the magnetic induction lines of a magnet characterized in that the lines of magnetic induction inherent to the magnet are conveyed by the ferromagnetic end surface rather than diverged to outside in order to maximize the attracting power of the magnet. The paths of the magnetic induction lines are formed at a center hole bored in the magnet. The invention may be used as a clasp or lock for bags, boxes, bands or chains and has wide application for suitcases, handbags and purses.

3 Claims, 18 Drawing Figures

CLASP UTILIZING ATTRACTIVE FORCE OF PERMANENT MAGNET

This application is related to the following co-pending applications of the applicant: Ser. No. 477,838 filed Mar. 25, 1983, now U.S. Pat. No. 4,453,294 a continuation of Ser. No. 309,762 filed Oct. 8, 1981 (now abandoned), which was a continuation of Ser. No. 89,134 filed Oct. 19, 1979 (now abandoned); Ser. No. 222,984, filed Jan. 7, 1981; Design Ser. No. 258,039, filed Apr. 27, 1981.

BACKGROUND OF THE INVENTION

1. Field of the Invention

The present invention relates to a clasp utilizing the attraction of a permanent magnet, and more particularly to obviating such inconveniences as disruption of magnetic records by magnetic flux from such clasps by preventing the flux lines of the magnet from leaking externally.

2. Description of the Prior Art

There have been proposed various clasps which utilize the attraction of a permanent magnet, and almost all of them are conventionally aimed at effectively using the magnetic attraction of a permanent magnet rather than taking counter-measures to prevent disruption of magnetic records by the permanent magnet.

As great innovations have been achieved in the recording technology recently and magnetic recording means such as tapes, cards or notes have become household items, safeguarding those means demands special attention and care.

We have entered an era where articles having magnetic records are used daily, such as various magnetic tapes and magnetic disks to tickets for transportation, admission tickets, or cash cards for bank accounts.

The content of such magnetic records as recording tapes, etc., however, can be lost because they are easily destroyed when placed under the influence of the magnetic flux lines of a magnet and the occurrence of such a disruption can not easily be observed from outside appearance.

BRIEF SUMMARY OF THE INVENTION

The clasp according to the present invention was contrived especially as a counter-measure for the above mentioned problems. It can obviate the disruption of magnetic records contained in tapes, etc. by minimizing the leakage of magnetic flux from a magnet used in a clasp and by preventing the magnetic polar surface of the magnet from contacting directly the tapes, etc.

The present invention is characterized in that the lines of magnetic induction inherent to a magnet is converged on the magnetic attraction end surface rather than diverged to outside in order to maximize the attracting power of the magnet which has only a specific number of magnetic induction lines. It is characterized more particularly in that the magnetic induction lines of a permanent magnet used are induced at respective poles to form magnetic fields and prevented from diverging to outside so that the paths of those magnetic induction lines are directed at a center hole bored on the magnet.

The present invention has been embodied as a clasp or lock for bags, boxes, bands or chains and is expected to have wide potentiality in application for various fields such as handbags, suitcases, daypacks, purses and pouches, belts, shoulder bag straps, necklaces, pendants, etc.

BRIEF DESCRIPTION OF THE DRAWINGS

The present invention will now be further described in greater detail with reference to the accompanying drawings wherein.

DETAILED DESCRIPTION

Various embodiments of the present invention will now be explained together with the operational effects attained by them.

Figure 1:
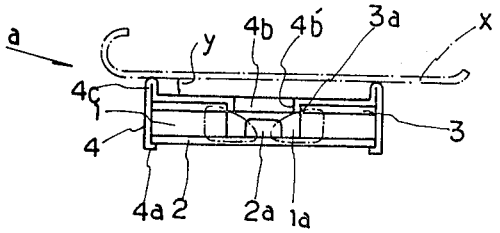
FIG. 1 is a cross sectional view to show the operational effects of a female clasp part of an embodiment of the present invention.
Figure 2:
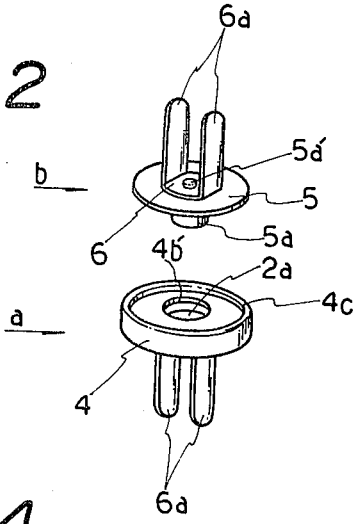
FIG. 2 is a perspective exploded view of a male/-female clasp.
Figure 3:
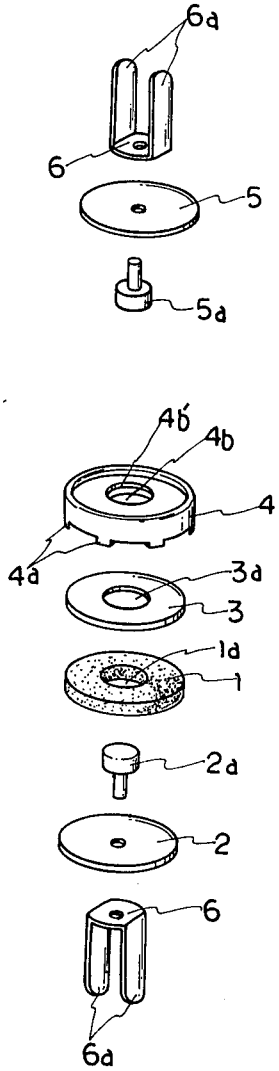
FIG. 3 is a perspective exploded view of the parts of the clasp of FIG. 2, FIGS. 4 to 6 are cross-sectional views of embodiments of the invention to show how to construct the magnetic paths, FIG. 7 a cross-sectional view of another embodiment.

In FIG. 1 a female part a is shown in cross section for facilitating understanding of the typical operational feature of the clasp according to the present invention wherein a permanent magnet 1 having a hole 1*a* along the magnetic pole surface is provided with a ferromagnetic metal plate 2 on one of the magnetic poles in a manner to close the said hole 1*a*, a ferromagnetic metal plate 3 having a hole 3*a* communicating with the hole 1*a* is provided on the other magnetic pole surface and the metal plates 2 and 3 and the magnet 1 are encased integrally in a case 4 made of a non-magnetic material.

The case 4 is constructed so as to form a hollowed-out dish shape at the upper surface as shown and is provided with tabs 4*a* and at the peripheral edge thereof and a hole 4*b* at the center with a collar 4*b'* on the internal edge thereof which protrudes into the hole 3*a* and also abuts against the surface thereof. The parts mentioned above are assembled integrally by successively attaching the metal plate 3, the magnet 1 the metal plate 2 by bending the tabs 4*a* inwardly toward the metal plate surface 2. A protruding peripheral edge 4*c* is constructed by bending the end of the internal bottom of the case 4, or the end which abuts against the outer periphery of the metal plate 3, toward the direction which perpendicularly crosses the magnetic pole surface of the magnet 1.

When a ferromagnetic protrusion 2*a* is provided at the hole 1*a* of a female part of the structure mentioned above, the magnetic induction lines of magnet 1 are generated as illustrated by a dot-and-dash line and are not diverged externally at all. By providing the metal plates 2 and 3 on the magnetic pole surface of the magnet 1 the magnetic induction lines are made to converge to the metal sheets 2 and 3 to form separate and respective magnetic fields. The converged magnetic induction lines are further made to communicate with respective magnetic fields via the protrusion 2*a* which has the least magnetic resistance and thus is suitable as the path therefor.

Provision of the metal sheets 2 and 3 eliminates possible generation of magnetic induction lines outside the female part a and leads to such advantageous effects as the maximum lines of magnetic induction of the magnet are converged to one location, thereby eradicating the inconveniences entailed by the leakage of magnetic induction lines as in the prior art.

Even if a magnetic recording means such as a magnetic tape x is placed near the female part a, the magnetic record therein would not become destroyed by the magnetic induction lines of the magnet 1 at all, thus presenting a new and convenient possibility that magnetic tape or cards of this type can be handled in the same area as the female clasp means. More particularly, the magnetic disruption lines of the magnet 1 are converged on the metal plates 2 and 3 to form a closed circuit via the protrusion 2*a* to prevent the leakage from the magnet 1, the metal plates 2 and 3. The magnet 1 and the metal plates 2 and 3 are simultaneously housed in a case made of non-magnetic materials so as to eliminate the possibility for magnetic tapes or cards coming into contact with the magnet 1 or the metal sheets 2 and 3.

The magnetic tapes, etc. are forced to contact with the female clasp a only through the magnetic gap of a thickness equal to the case 4 even if they are brought close thereto, thereby completely preventing the records contained therein from becoming destroyed.

Provision of the protruding periphery 4*c* on the case 4 results in a wider magnetic gap y between the magnetic pole surface and the tape x, thereby providing a safeguard on the magnetic pole surface where magnetic disturbance most often occurs. The protruding periphery is further advantageous in that it effectively prevents tapes x etc. from falling into the hole 1*a* which is the only place magnetic induction lines are exposed so as to effectively prevent the destruction of the record therein. The protrusion 4*c* further prevents the lateral displacement of a male clasp part b which is separately provided. It can completely prevent undesired disengagement of the clasps caused often by lateral forces exserted in pulling or peeling off which is heretofore considered the most formidable problem.

Figure 4:
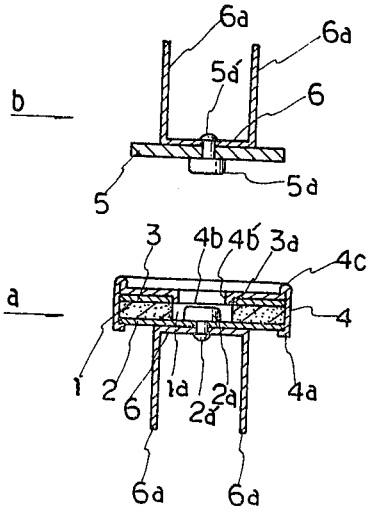

The male clasp part b is engageable within the protrusion 4*c* of the female clasp part a, and comprises a ferromagnetic metal plate 5 closely attracted on the magnetic pole surface and protrusion 5*a* of ferromagnetic material which contacts with the top end of the protrusion 2*a* within the hole 1*a*. As shown in FIG. 4, the parts are integrally assembled by inserting a rod of a small diameter on the protrusion 5*a* through the metal plate 5 and a washer 6 which is engaged on the metal sheet 5 and by upsetting the top protruding end 5*a*'.

The female clasp part a is also assembled by mounting a washer 6 on the metal plate 2, inserting a rod of a small diameter on the protrusion 2*a* through the metal plate 2 and a washer 6 and by upsetting the protruding end 2*a*'.

Figure 15:
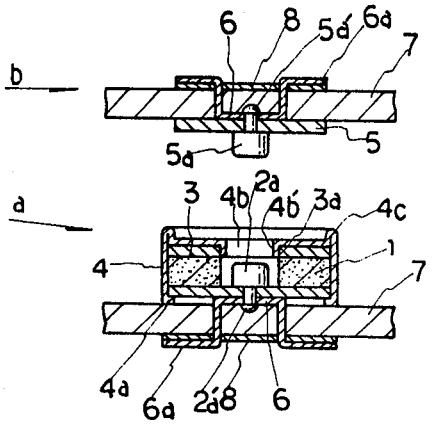
Figure 16:
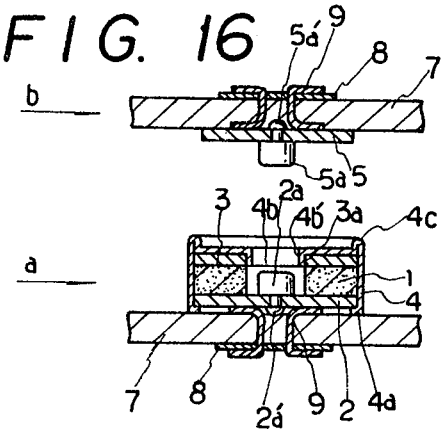

The fastening washer 6 as illustrated in FIG. 15 is adapted to extend legs 6*a* and 6*a* through such materials as leather 7, to which the clasp according to the present invention is applicable, and through slots in a washer 8 to have the legs bent over the washer 8 for retaining the female and male clasp parts to the material.

Figure 5:
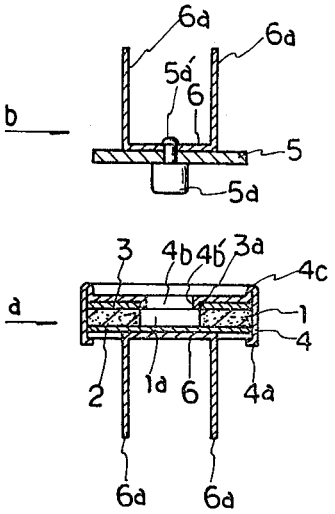
Figure 6:
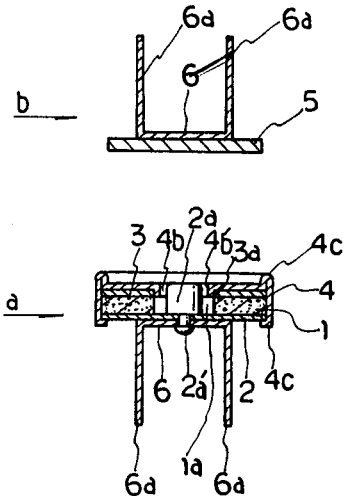

In the embodiment shown in FIG. 5 the protrusion 2*a* is omitted and the protrusion 5*a* of the male member b is made to directly contact with the metal plate surface 2 which is the bottom surface of the hole 1*a* for attraction. In the embodiment shown in FIG. 6, the protrusion 5*a* is omitted and the protrusion 2*a* is adapted to directly contact and be attracted on the metal plate 5.

Figure 7:
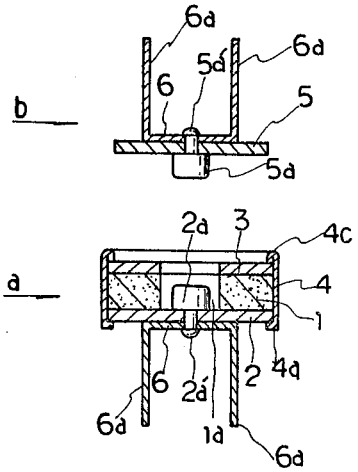

FIG. 7 shows still another embodiment wherein the metal plate 3 is directly pressed on and retained by the bent periphery of the protrusion 4*c* on cylindrical case 4 for integrating the magnet 1, and the metal plates 2 and 3. This embodiment has an exposed surface on the metal plate 3. In this embodiment it is aimed to cut down moulding cost of the case by utilizing the protruding periphery 4*c* as a preventive spacing means for tapes x.

In the embodiments shown in FIGS. 8 to 14, various attachments for the female/male clasp members described above are illustrated.

Figure 8:
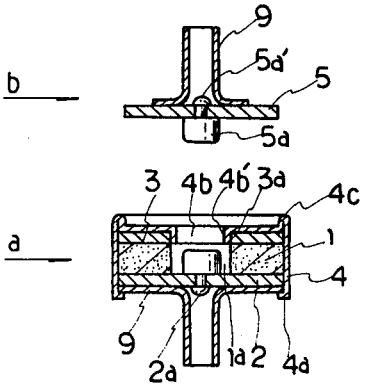
FIGS. 8 to 14 are cross-sectional views to show other various embodiments of the clasp according to the present invention and FIGS. 15 to 18 are cross-sectional views to show still further embodiments of the invention.

In the embodiment shown in FIG. 8, a connecting tube 9 of a flute type is attached to the female/male members either by welding or with tabs 4*a* to form an attaching means for the members on leather or other materials.

Figure 9:
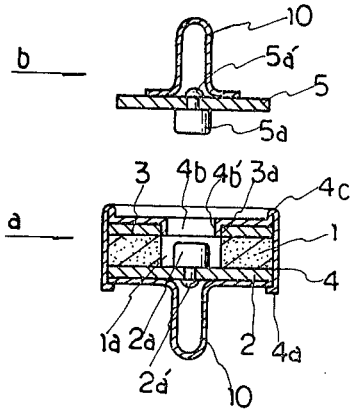
Figure 10:
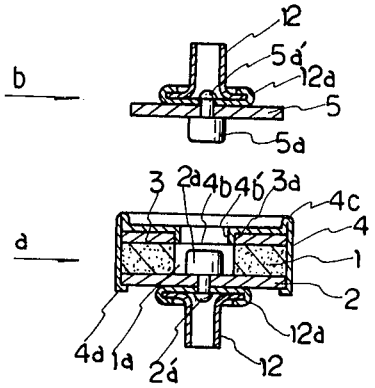
Figure 17:
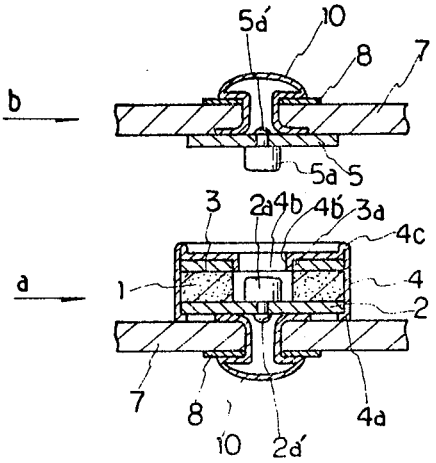
Figure 18:
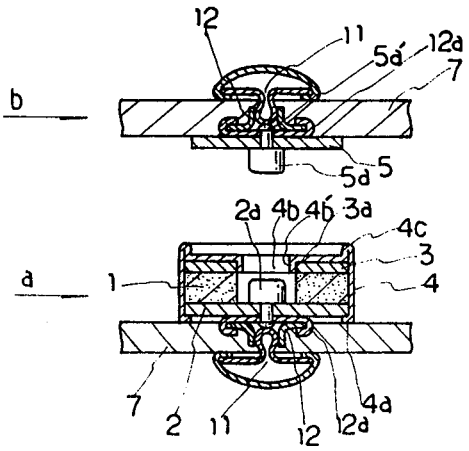

In the embodiment shown in FIG. 9 the above mentioned connecting tube 9 of a flute type is provided with a closed end to be used in the same manner as shown in FIG. 17. In the embodiment illustrated in FIG. 10 the connecting tube 12 is provided with a washer 12*a* so that the diverging end of tube 12 is engaged by the collar which is formed by bending the washer 12*a* around the diverging end. The washer is then attached to the female/male members by the same upsetting method and means as described above for the members 2*a*' and 5*a*'. A connecting tube 11 in the form of a flute with or without bottom may be separately provided so as to be inserted into the tube 12, which is flattened for engagement as shown in FIG. 18.

Figure 11:
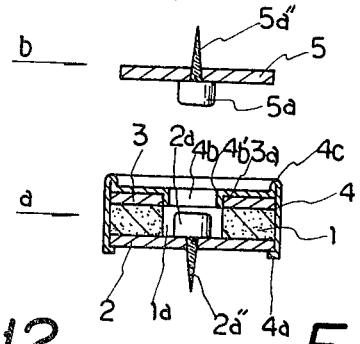
Figure 12:
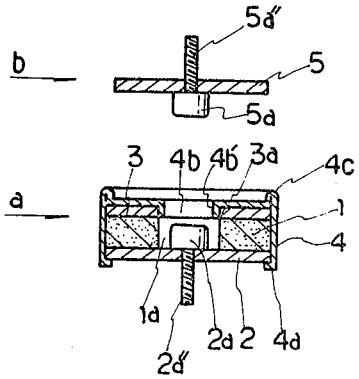
Figure 13:
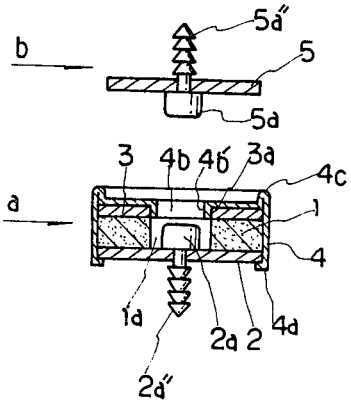

In the embodiments shown in FIGS. 11 to 13, the rod of small diameter on the protrusions 2*a* and 5*a* are constructed as threaded rods 2*a*'' and 5*a*'' to be attached to leather or other materials by such methods as screwing FIG. 11, nut tightening FIG. 12, or hammering in FIG. 13.

Figure 14:
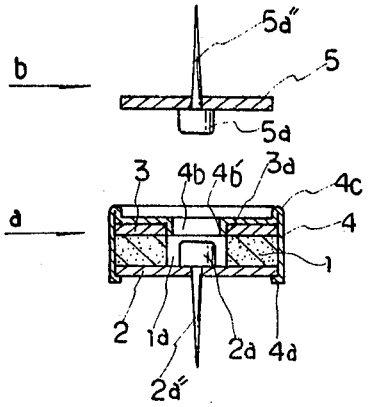

In the embodiment shown in FIG. 14 the rod of small diameter on the protrusions 2*a* and 5*a* is made in the form of a pointed pin rod 2*a*'' and 5*a*'' is adapted to be attached to leather and other materials by pressing or thrusting therein.

I claim:

1. A magnetic fastener comprising:

(a) a first fastening element, including a permanent magnet having oppositely facing pole faces of opposite polarity and at least one peripheral edge, said magnet having a hole extending between the first pole face and the second pole face;

a first ferromagnetic plate in contact on one face thereof with said first pole face;

a first fastening means extending from the other face of said first ferromagnetic plate;

a first ferromagnetic rod disposed within and coaxial with said hole and secured to said one face of said first ferromagnetic plate;

a magnetic shielding ferromagnetic plate in contact with said second pole face and having an opening passing therethrough, which opening is coaxial with said hole; and a nonmagnetic housing having an edge portion surrounding the at least one peripheral edge of said permanent magnet, inwardly directed extensions on said edge portion for securing said first ferromagnetic plate and said magnetic shielding ferromagnetic plate to said permanent magnet, said extension on the edge portion of said housing adjacent said magnetic shielding ferromagnetic plate extending over said shielding plate and having a protruding rim at its periphery where it joins said edge portion to form a dish-shaped upper surface, and an aperture coaxial with said hole in said upper surface; and (b) a second fastening element detachably engageable with said first fastening element, including a second ferromagnetic plate having a peripheral size smaller than said rim;

a second fastening means secured to said second ferromagnetic plate; and a second ferromagnetic rod secured to said second ferromagnetic plate, so that when the first and second fastening elements are engaged, said first ferromagnetic rod projects into said hole and contacts said second ferromagnetic rod and said second ferromagnetic plate contacts said dish-shaped upper surface of said housing within said rim.

2. A magnetic fastener comprising:

(a) a first fastening element, including a permanent magnet having oppositely facing pole faces of opposite polarity and at least one peripheral edge, said magnet having a hole extending between the first pole face and the second pole face;

a first ferromagnetic plate in contact on one face thereof with said first pole face;

a first fastening means extending from the other face of said first ferromagnetic plate thereof;

a ferromagnetic rod disposed within and coaxial with said hole and secured to said one face of said first ferromagnetic plate;

a magnetic shielding ferromagnetic plate in contact with said second pole face and having an opening passing therethrough, which opening is coaxial with said hole; and a nonmagnetic housing having an edge portion surrounding the at least one peripheral edge of said permanent magnet, inwardly directed extensions on said edge portion securing said first ferromagnetic plate and said magnetic shielding ferromagnetic plate to said permanent magnet, said extension on the edge portion of said housing adjacent said magnetic shielding ferromagnetic plate extending over said shielding plate and having a protruding rim at its periphery where it joins said edge portion to form a dish-shaped upper surface, and an aperture coaxial with said hole in said upper surface; and (b) a second fastening element detachably engageable with said first fastening element; including a second ferromagnetic plate having a peripheral size smaller than said rim, and a second fastening means secured to said second ferromagnetic plate, so that when the first and second fastening elements are engaged, said ferromagnetic rod contacts said second ferromagnetic plate and said second ferromagnetic plate contacts said dish-shaped upper surface within said rim.

3. A magnetic fastener comprising:

(a) a first fastening element, including a permanent magnet having oppositely facing pole faces of opposite polarity and at least one peripheral edge, said magnet having a pole extending between the first pole face and the second pole face;

a first ferromagnetic plate in contact on one face thereof with said first pole face;

a first fastening means extending from the other face of said first ferromagnetic plate;

a magnetic shielding ferromagnetic plate in contact with said second pole face and having an opening passing therethrough, which opening is coaxial with said hole; and a nonmagnetic housing having an edge portion surrounding the at least one peripheral edge of said permanent magnet, inwardly directed extensions on said edge portion securing said first ferromagnetic plate and said magnetic shielding ferromagnetic plate to said permanent magnet, said extension on the edge portion of said housing adjacent said magnetic shielding ferromagnetic plate extending over said shielding plate and having a protruding rim at its periphery where it joins said edge portion to form a dish-shaped upper surface, and an aperture coaxial with said hole in said upper surface; and (b) a second fastening element detachably engageable with said first fastening element; including a second ferromagnetic plate having a peripheral size smaller than said rim;

a second fastening means secured to said second ferromagnetic plate; and a ferromagnetic rod secured to said second ferromagnetic plate, so that when the first and second fastening elements are engaged, said second ferromagnetic rod projects into said hole and contacts said first ferromagnetic plate and said second ferromagnetic plate contacts said dish-shaped upper surface within said rim.

* * * * *